US005728028A

United States Patent [19]

Dusch

[11] Patent Number: 5,728,028

[45] Date of Patent: Mar. 17, 1998

[54] MATERIAL AND METHOD TO ASSIST IN EXERCISING FACIAL MUSCLES

[76] Inventor: Perry R. Dusch, 7338 E. Sabino Terrace Pl., Tucson, Ariz. 85750

[21] Appl. No.: 683,616

[22] Filed: Jul. 17, 1996

[51] Int. Cl.[6] ..... A63B 23/03; A61H 1/00

[52] U.S. Cl. ..... 482/11; 424/78.03

[58] Field of Search ..... 482/11; 606/204.35; 424/485, 78.03; 514/844

[56] References Cited

U.S. PATENT DOCUMENTS

| | | | |
|---|---|---|---|
| 2,882,892 | 4/1959 | Kosier | 482/11 X |
| 3,507,493 | 4/1970 | Robins | 482/11 |
| 3,949,741 | 4/1976 | Hofmann | 606/204.35 |
| 4,126,142 | 11/1978 | Saute | 424/78.03 |
| 4,189,141 | 2/1980 | Rooney | 482/11 |
| 4,195,833 | 4/1980 | Svendsen | 482/11 |
| 4,666,148 | 5/1987 | Crawford | 482/11 |
| 4,823,778 | 4/1989 | Ewing | 606/204.35 |
| 4,854,307 | 8/1989 | Elfenbein | 606/204.35 X |
| 4,892,092 | 1/1990 | Klein | 606/204.35 |
| 4,965,071 | 10/1990 | Kawan | 514/844 X |
| 5,139,771 | 8/1992 | Gerstein | 514/844 X |
| 5,396,881 | 3/1995 | Kein | 606/204.35 X |

OTHER PUBLICATIONS

St Louis Post Dispatch, Sunday Apr. 15, 1990 "Coming Clean . . . ", By Elain Brumber.

Atlanta Constitution, Sunday, Nov. 19, 1995 "Dixie Style in Fashion Briefs Beige . . . ", by Staff.

*Primary Examiner*—Richard J. Apley
*Assistant Examiner*—William LaMarca
*Attorney, Agent, or Firm*—Schmeiser, Olsen & Watts

[57] ABSTRACT

The invention is a facial mask, that when applied to the skin as a liquid latex formulation, will dry to a rubberized consistency creating a resistance to facial muscle movement similar to the resistance bands used in home exercise machines. This resistance is increased by adding additional layers of the mask. Once exercises are complete, the mask is removed by simply peeling it from the skin, leaving the skin feeling soft and muscles of the face feeling firm and taut.

14 Claims, 3 Drawing Sheets

MATERIAL AND METHOD TO ASSIST IN EXERCISING FACIAL MUSCLES

BACKGROUND

This application is a continuation-in-part of the provisional patent application entitled "Exer-Mask" by Perry R. Dusch as filed Jul. 20, 1995, with Ser. No. 60/001,260.

This invention relates generally to exercise assist devices and more particularly to apparatus and materials used for the exercise of the facial muscles.

The force of gravity upon facial muscles is directly responsible for the gradual decline in muscle tone and facial contour. Due to lost facial muscle tone, the muscles begin to elongate and sag; further, as a result of the muscle's loss of tone, the muscles also lose their elasticity and ability to hold up the skin covering the muscle.

Since the skin does not have the strength to hold up sagging muscles, the skin also begins to sag causing an effect which is perceived as a natural aging process.

Fortunately, this "aging" condition of the skin is directly related to the condition of the muscles and can be reversed to an uplifted shape with proper exercise. In this context, resistance exercise will shorten and fill out the musculature of the face therefore pulling up and filling out sagging and loose skin. While resistive exercise has been shown to be extremely beneficial for other muscles, an efficient mechanism for providing resistive facial exercises has been difficult to obtain.

Up until now, a face lift by surgery was the only practical answer to tightening and lifting a face which has fallen. The sad part is that this is only touching the surface and not the underlying problem.

Tightening the skin through surgery seems to be the answer for a lot of people for two reasons: (1) few understand or realize that the flabby skin under the eyes and the sagging, drooping cheek and jowl areas are merely signs of elongated and out of shape muscles that are connected and constantly pulling downward; and (2) there are few if any other options.

Covering the muscle is a thin layer of skin that conforms to the shape of the underlying muscle tissue. If the muscle is sagging, then the skin covering that area will also sag, but if muscle is toned, strengthened, and shortened through exercise, the skin will conform to its original shape.

The muscles of the face are no different than the muscles of the body from a standpoint of responding to adaptive stress. Men and women throughout the country join gyms everyday to lift droopy rears and tone sagging pectorals.

After face-lift surgery, the skin does not have the strength to hold up elongated and out of shape muscles, and by merely tightening the skin by surgery, the "anti-aging" effects can only be temporary as the heavier underlying muscles will continue to sag and will put undo force against the surface skin, pulling downward on the skin and thereby forcing repeated surgeries.

The skin is comprised of two layers, the first being the epidermis. The epidermis is a very fine outer skin layer which is continuously forming new cells. Dead cells of the surface need to be removed more frequently with the advancement of age due to the slowing of the exfoliation process. It is very important to exfoliate the dead surface cells in order to allow the new cells to come to the surface.

The underlying layer of skin is the dermis, which is comprised of sebaceous glands, sweat glands, capillaries, and nerves. The capillaries are tiny blood vessels which have the responsibility of delivering nutrients to the facial skin and muscles. Due to age, the capillaries begin to constrict and the face begins to loose that youthful glow. Fortunately, exercising the muscles of the face with proper technique and resistance, will open up these blood vessels and increase nutrient flow to the working muscles and the skin.

Muscle tissue is constantly going through biological changes involving building, shaping, or elongating and atrophying, from the beginning to the end of life. The muscles of the body and the face are flexible, elastic tissues, that can be built and therefore change shape or condition at any time during life.

The shape of the face is largely determined by the condition of the underlying muscles beneath the skin. A young persons's face has strong and elastic muscles and therefore has more evenly formed and firm facial structure. However, with passing years and the force of gravity, the muscle structure gradually succumbs to gravity's pull.

Depending on age, size, and weight of the face, by the time most people reach their fifties the cheek muscles alone may have elongated by as much as an inch indicating that we have an inch of extra skin hanging on the lower facial region. The results of this elongation causes hollowed upper cheeks, flabby lower cheek areas, sagging jowls, and pouches on the side of the mouth and chin.

The muscles of the upper eyelid also begin to sag, causing eyelids to hang over eyelashes and eyebrows to droop downward. Other symptoms are increased bags under eyes due to lower lid elongation and the much feared "turkey neck," due to atrophy and elongation of the muscles attached to the throat.

The skin of course, will always follow its foundation, which is the underlying muscle structure. This gives the impression of having too much skin because of sagging and overlapping, but in reality it's the muscle pulling the skin down with it.

For many years the aging process of the face has been diagnosed improperly. Only looking at the surface of the problem and treating it as such, always blaming the skin itself for the wrinkles and creases that give the appearance of an aging face. Many companies are now marketing products that imply face lift effects.

While these products have some immediate effects, the change is at best temporary. These products are topical creams and lotions that when applied to the surface of the skin, dramatically increasing exfoliation of dead surface cells, therefore to a certain degree, decreasing the depth of these lines and wrinkles. These products also cause temporary fluid retention in the area applied, giving the illusion of filled out wrinkles and lines on the face.

This is only scratching the surface, because no amount of cream or lotion can lift the sagging and drooping underlying muscles, which have more of an effect on the condition of the skin than most realize.

It is clear from the foregoing that there is a significant need for a methodology which will assist in the exercising of facial muscles.

SUMMARY OF THE INVENTION

The muscles of the face cannot be adequately strengthened by everyday activities such as talking, eating, smiling, and so on, since these are either involuntary movements or do not contract the muscles to their fullest capacity. The facial muscles like the muscles of the body need to be exercised with proper resistance applied to the area of muscular involvement. The muscles then respond by firming and shortening in length, providing a lift and increased facial firmness.

The invention utilizes a facial mask, that when applied to the skin as a liquid latex formulation, dries to a rubberized consistency creating a resistance similar to the resistance bands used in home exercise machines. This resistance to muscular movement is increased by adding additional layers of the mask. Once the appropriate exercises are completed, the latex mask is removed by simply peeling it off, leaving skin feeling soft and muscles of the face feeling firm and taut.

In the preferred embodiment, the characteristics of the liquid latex formulation are as follows:

(1) Consistency: The consistency of the latex mask needs to be such that it does not: (a) prematurely polymerize due to being too thick, and, (b) have a runny consistency which will cause problems with the latex's application.

(2) Drying: The mask needs to dry to a proper rubberized consistency creating a proper resistance for exercises to be performed.

(3) Moisturizing: The addition to the latex formulation of aloe vera gelatin gives the resulting mask an additional benefit of moisturizing and softening the skin while exercises are being performed; thus improving the overall texture and elasticity of the mask.

(4) Fragrance: Preferably the latex formulation also includes a water-soluble fragrance (e.g. mint, rose or powder fresh) to hide a slight ammonia smell.

(5) Duration: Proper formulation of mask should permit twenty minutes of exercises to be performed without prematurely peeling off.

(6) Removal: The mask should be easily and safely removed when exercises are concluded.

To this end, the preferred formulation for the invention is: 2.5 oz. latex to 1 oz. aloe vera gelatin. The general components to the preferred mask are:

Natural Latex, Water, Ammonia, Tetramethyl Thiurum Disulfide, Zinc Oxide, Aloe Vera Gel, Propylene Glycol, Tea-Carbomer 940, E.D.T.A., Methylparaben, Imidazolidinyl Urea, Sodium Benzoate, Potassium Benzoate, Potassium Sorbate Those of ordinary skill in the art readily recognize the component percentages which obtain the above objectives.

Application of the liquid latex combination to a clean and dry face obtains optimal results. Preferably, the liquid latex formulation is applied to the face as follows:

Step 1—Pull hair back and away from face;

Step 2—Dip applicator into liquid latex and apply generous amount in smooth downward strokes. Smooth over each area very quickly and do not go over same areas repeatedly due to quick setting action of the mask;

Step 3—Paint mask from base of nose to outside of cheekbone and down to jaw line and then cover areas above and below, but not directly on, the lips. Also cover chin and just under chin and jaw line.

Step 4—Starting half an inch below the hairline, paint down to just above the eyebrows, covering the forehead area.

Step 5—Blow dry on cool setting for 2 minutes to set mask (optionally, lightly heated air may be used).

While there are many exercises which can utilize the resistive nature of the present invention, the following facial exercise regimen is preferred. This preferred regimen comprises six different exercises which are done in three cycles, each cycle including all six exercises in sequence.

Exercise #1—Forehead area

Step 1 Bringing brows down and together. Hold this position through entire exercise;

Step 2 While keeping tension on muscles, raise muscles above brow area and hold for two seconds and then return to starting position for two seconds.

Do twenty repetitions.

Exercise #2—Under eyes, side of nose and cheek area.

Step 1 Open mouth forming an O, drop jaw to create a fully stretched position for these muscles. Hold for two seconds;

Step 2 While holding in this position, raise muscles under the eyes as if to squint and hold for two seconds.

Do 20 repetitions.

Exercise #3—Lips (upper and lower) also including cheek area.

Step 1 Push lips together and as far forward as possible. Hold for two seconds;

Step 2 While keeping lips in pushed position, stretch face in side-to-side manner holding each contraction for two seconds.

Do 20 repetitions.

Exercise #4—Chin and neck area.

Step 1 Push lips and hold two seconds;

Step 2 From pushed position, bring outside corners of mouth out and downward as if to frown. Stretch downward as far as possible and hold for two seconds.

Do 20 repetitions.

Exercise #5—Jaw area

Step 1 Pucker lips as far forward as possible and bring jaw forward, now keeping lips together bring jaw down and hold for two seconds;

Step 2 Use jaw muscles to raise and push upper lip to touch nose. Hold for two seconds.

Do 20 repetitions.

Exercise #6—Full face combination

Step 1 Keeping teeth together pucker lips as if to whistle at the same time, bring eyebrows down. Hold for two seconds;

Step 2 While keeping teeth together, slowly spread lips, open in a fashion that would expose teeth while lips are still puckered. Hold for two seconds;

Step 3 Now spread mouth open into big smile and raise forehead at same time. Hold for twenty seconds.

Do 20 repetitions.

After the exercise regimen has been completed, the dried latex mask is easily removed by rolling from its outside edges inward and then easily peeling off. Another method of removal of the mask uses warm water or a warm wet towel to soften the mask to assist in its removal.

After removal of the mask, the user should wash his/her face with mild moisturizing cleanser.

The invention provides adequate external resistance to the muscles of the face, allowing for full stimulation. The invention not only tones and strengthens the muscles of the face, but will also tightens sagging skin that has conformed to the shape of the elongated underlying muscle tissue.

Other benefits include removal of dead skin cells bringing new living cells to the surface through an advanced exfoliation process.

Also, another major benefit of the use of the mask and the associated exercising is the increased circulation to the working muscles of the face, therefore increasing nutrient flow to muscles and skin.

The invention, together with various embodiments thereof, will be more fully explained by the attached drawings and the following descriptions.

DRAWINGS IN BRIEF

DRAWINGS IN DETAIL

Figure 1:
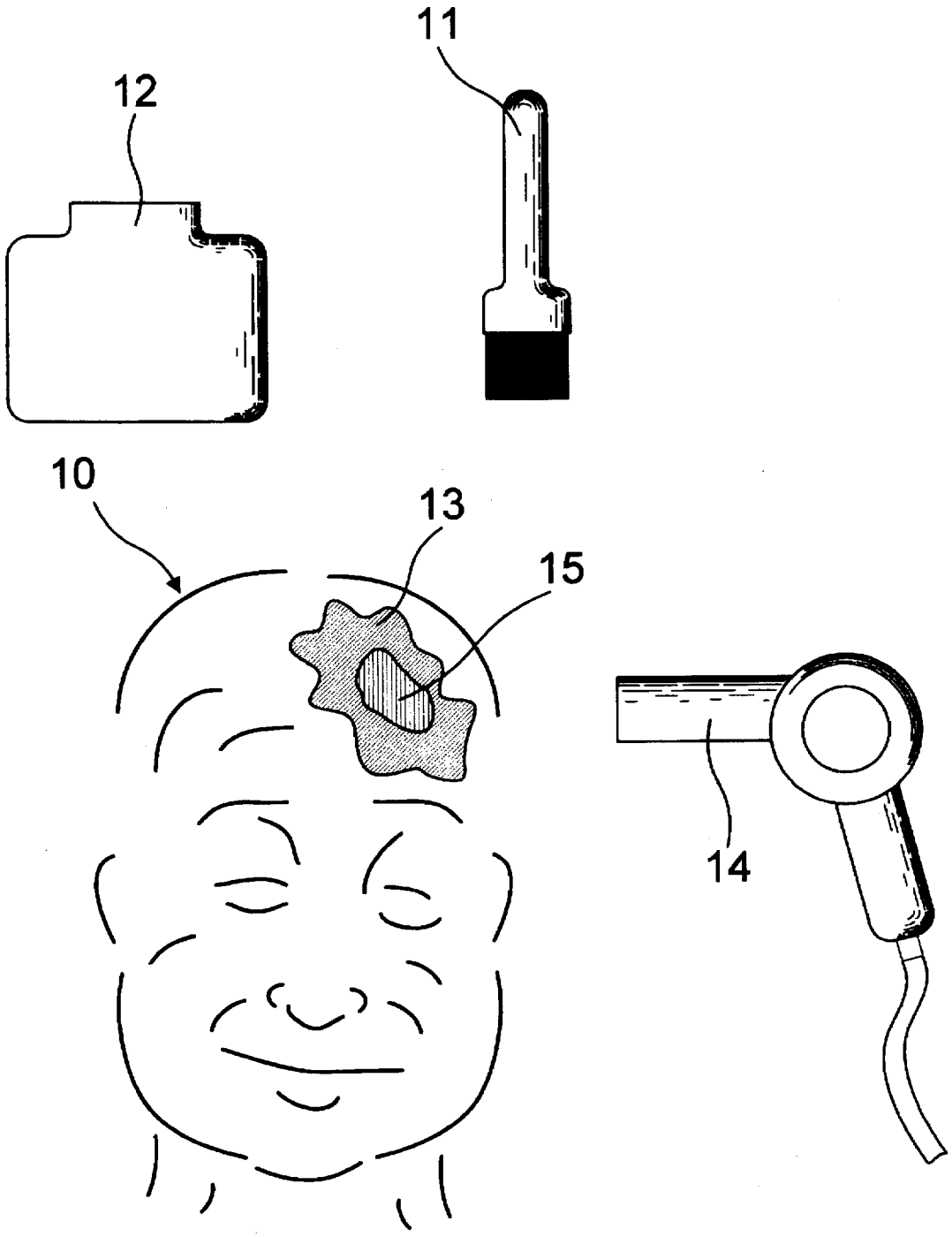
FIG. 1 is a frontal view of a face with skin deleted to illustrate the relationship of the latex mask to the underlying muscles.

FIG. 1 is a frontal view of a face with skin deleted to illustrate the relationship of the latex mask to the underlying muscles.

In this illustration, applicator 11 is being used to apply the latex mask 15 from container 12 onto the facial zone 13 of user 10. Latex mask 15 of this illustration is a formulation having a relationship of approximately 2.5 ounces of latex to 1 ounce of aloe vera gelatin.

Application of the liquid latex using applicator 11 is accomplished easily by dipping applicator 11 into the liquid latex from container 12 and applying generous amounts in smooth downward strokes over zone 13.

If desired, blow dryer 14 is used to assist in assisting latex mask 15 to dry; a preferred method for drying of the liquid latex is simply allowing the ambient air to dry the composite.

Note that zone 13 overlies the muscles to be exercised (the right brow muscles in this illustration). This overlay provides for an "anchoring" affect to give an additional resistive capability to the present invention.

Figure 2:
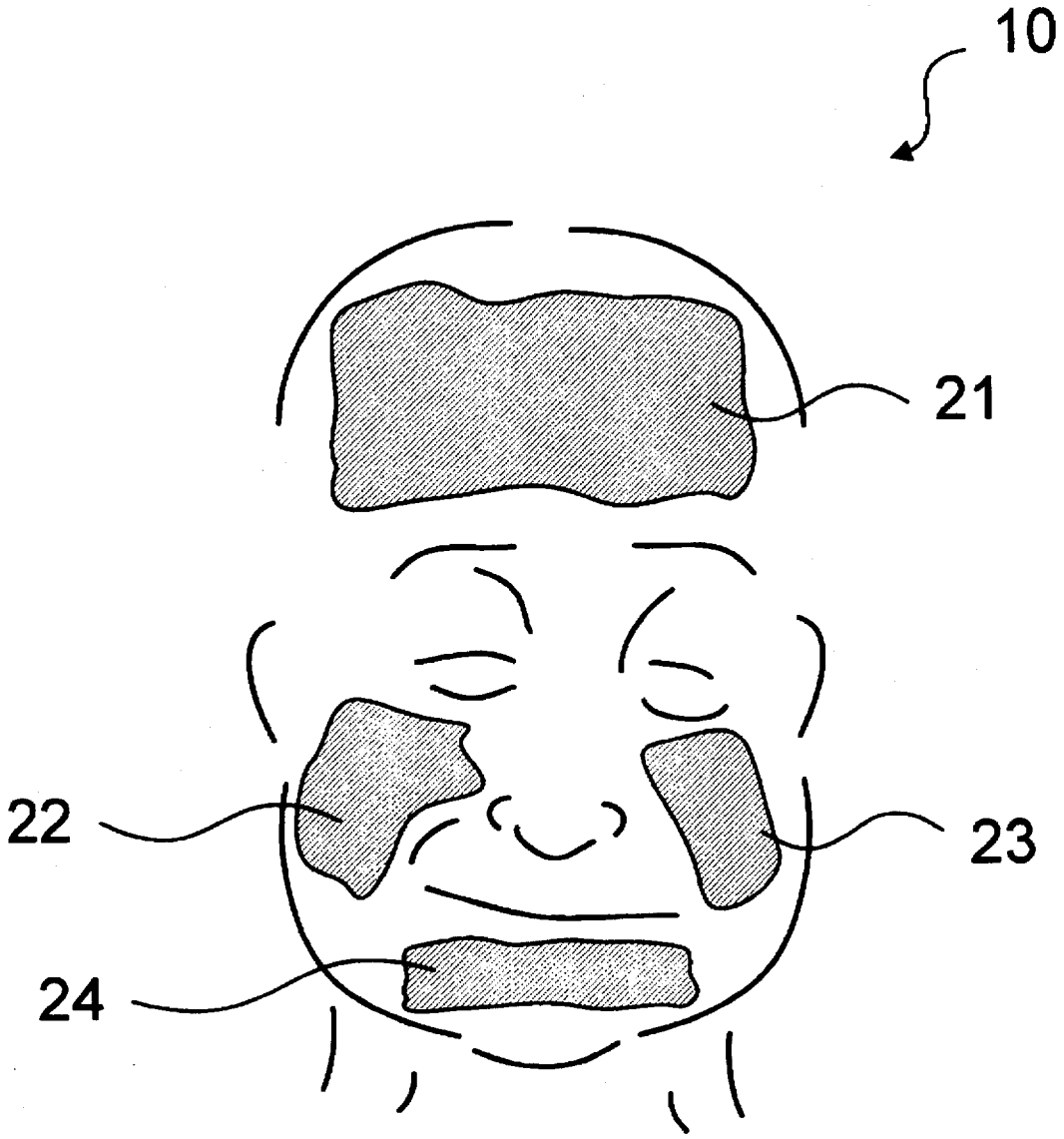
FIG. 2 is a frontal view of a face illustrating the preferred zones for application of the latex mask.

FIG. 2 is a frontal view of a face illustrating the preferred zones for application of the latex mask.

The key areas for application of the latex mask are shown for user 10 as brow 21, right cheek 22, left cheek 23, and chin area 24. These areas are most susceptible to the exercising affect of the dried latex mask.

Preferably application of the mask is by application from the base of the nose to the outside of cheekbone and down to jaw line. Further, the areas above and below, but not directly on, lips are covered.

Brow area 21 is preferably covered by starting half an inch below the hairline, user 10 paints down to just above eyebrows to cover the forehead area.

As applied as illustrated, when the liquid latex dries to a rubberized consistency, a resistance to muscular activity is created similar to the resistance bands used in home exercise machines.

Figure 3:
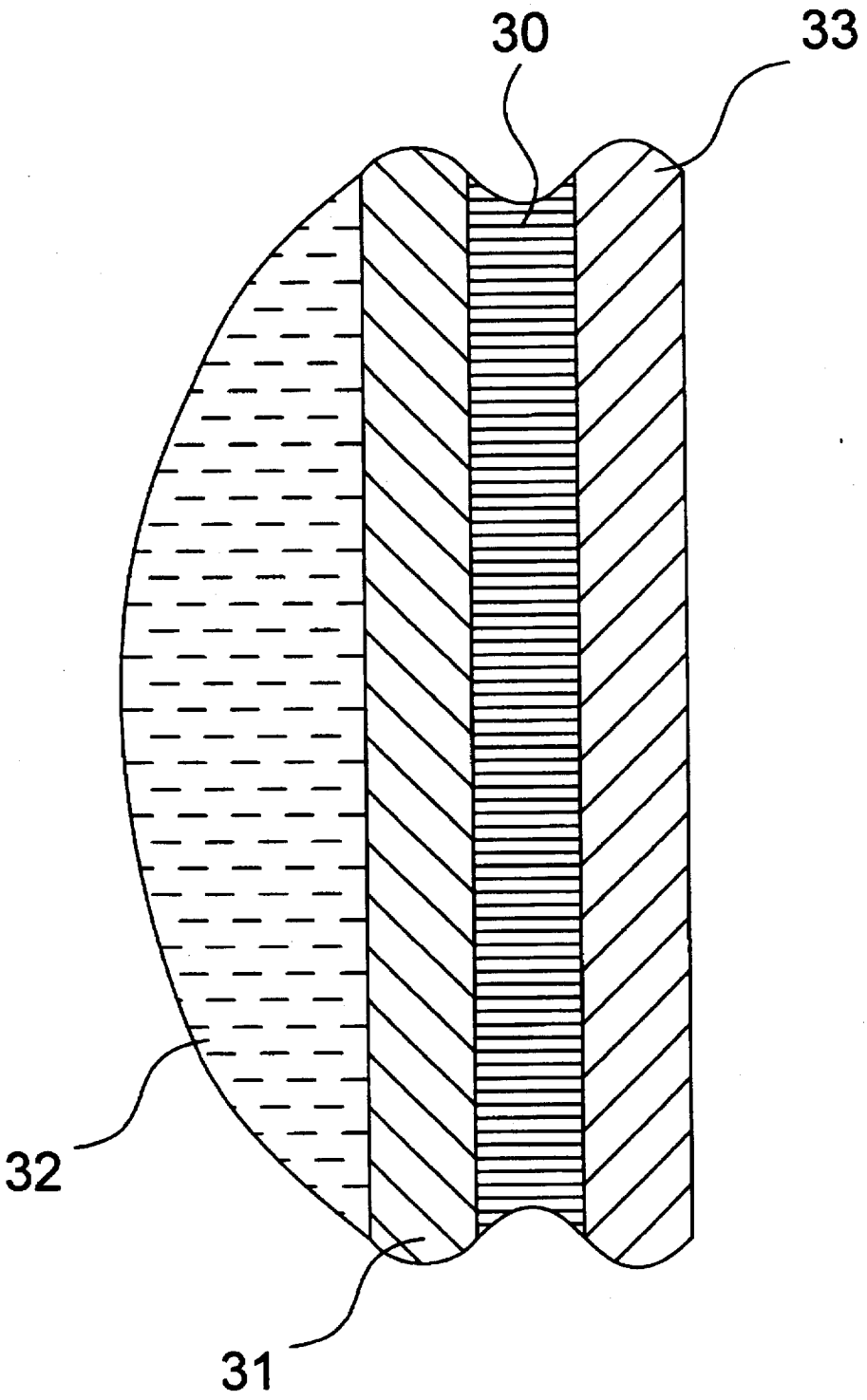
FIG. 3 is a cross-sectional view of the skin, muscle, and latex mask relationship.

FIG. 3 is a cross-sectional view of the skin, muscle, and latex mask relationship.

The skin is comprised of two layers, the first being the epidermis 30. The epidermis 30 is a very fine outer skin layer which is continuously forming new cells. The surface or dead cells need to be removed more frequently with advancing age due to the slowing of the exfoliation process. It is very important to exfoliate the dead surface cells in order to allow the new cells to come to the surface.

The underlying layer of skin is the dermis 31, which is comprised of sebaceous glands, sweat glands, capillaries, and nerves (not shown). The capillaries are tiny blood vessels which have the responsibility of delivering nutrients to the facial skin and muscles. Due to age, the capillaries begin to constrict and the face begins to loose that youthful glow. Exercising the muscles of the face 32 using the present invention opens up these blood vessels and increase nutrient flow to the working muscles and the skin.

Latex mask 33 provides resistive activity to the movement of muscles 32 to give muscle 32 an exercise regimen. Use of latex mask 33 tones and strengthens the muscles 32 of the face; this also tightens sagging skin.

The removal of dead skin cells of the epidermis 30 is accomplished when the latex mask 33 is peeled from the face. Another major benefit of the use of the latex mask 33 is that the associated exercising of muscle 32 increases the circulation to the working muscles 32 of the face which increases the nutrient flow to muscles 32 and skin (31 and 32).

The present invention provides for facial toning, strengthening, and lifting of the facial muscles, exfoliating dead surface skin, and increasing circulation and nutrient flow, to improve the appearance of the face.

What is claimed is:

1. An improved method for exercising facial muscles comprising the steps of:

a) applying a thin layer of liquid latex to a portion of a user's face;

b) allowing said liquid latex to dry on said face to a desired rubberized consistency, thereby providing a resilient film that provides resistance to the facial muscles underlying the dried layer of latex; and, c) repetitively contorting facial muscles beneath said dried layer of latex.

2. The method according to claim 1 wherein said latex is applied to areas beyond the muscles to be exercised.

3. The method according to claim 2 wherein the step of allowing said liquid latex to dry includes the step of directing an airflow against said liquid latex.

4. The method according to claim 3 further including the step of heating said airflow.

5. The method according to claim 2 wherein the step of applying a layer of liquid latex includes the step of substantially covering the face of the user with said liquid latex.

6. The method according to claim 2 further including the step of removing dried latex from the user's face after the step of repetitively contorting the facial muscles.

7. The method according to claim 6 wherein the step of removing dried latex includes the step of peeling said dried latex from the user's face.

8. A method of exercising facial muscles comprising the steps of:

applying a resistive layer to a user's face comprising the steps of:

1) applying a thin layer of liquid latex to a portion of a user's face over facial muscles to be exercised, and, 2) allowing said liquid latex to dry on said user's face to a desired rubberized consistency, thereby providing a resilient film that provides resistance to the facial muscles underlying the dried layer of latex; and, b) contorting the facial muscles through a pre-defined set of exercises chosen to stretch the dried latex.

9. The exercise method according to claim 8 wherein the step of contorting the facial muscles includes the steps of repetitively:

a) bringing the brows down and together;

b) while keeping tension on the brow, raising muscles above a brow area; and, c) allowing the facial muscles to relax.

10. The exercise method according to claim 8 wherein the step of contorting the facial muscles includes the steps of repetitively:

a) forming an O with the mouth;

b) dropping and holding the jaw to create a fully stretched position;

c) raising muscles under the eyes as if to squint; and, d) allowing the facial muscles to relax.

11. The exercise method according to claim 8 wherein the step of contorting the facial muscles includes the steps of repetitively:

a) pushing lips together and as far forward as possible;

b) stretching the face in side-to-side manner; and, c) allowing the facial muscles to relax.

12. The exercise method according to claim 8 wherein the step of contorting the facial muscles includes the steps of repetitively:

a) pushing the lips outward;

b) bringing the outside corners of the mouth out and downward as if to frown; and, c) allowing the facial muscles to relax.

13. The exercise method according to claim 8 wherein the step of contorting the facial muscles includes the steps of repetitively:

a) puckering the lips as far forward as possible;

b) bringing the jaw forward;

c) while keeping the lips together, bringing the jaw down;

d) raising and pushing the upper lip to touch the nose; and, e) allowing the facial muscles to relax.

14. The exercise method according to claim 8 wherein the step of contorting the facial muscles includes the steps of repetitively:

a) while keeping the teeth together, puckering the lips as if to whistle while at the same time, bringing the eyebrows down;

b) while keeping the teeth together, slowly spreading the lips to expose the teeth while the lips are still puckered;

c) spreading the mouth open into big smile and raising the forehead at same time; and, d) allowing the facial muscles to relax.

* * * * *